US006123059A

United States Patent [19]

Inaguma et al.

[11] Patent Number: 6,123,059

[45] Date of Patent: Sep. 26, 2000

[54] FUEL SUPPLY APPARATUS

[75] Inventors: Yoshitsugu Inaguma, Chita-gun; Nobuo Oota, Takahama, both of Japan

[73] Assignee: Denso Corporation, Japan

[21] Appl. No.: 09/146,196

[22] Filed: Sep. 3, 1998

[30] Foreign Application Priority Data

Sep. 5, 1997 [JP] Japan ..... 9-240822
Sep. 10, 1997 [JP] Japan ..... 9-245100

[51] Int. Cl.[7] ..... F02M 37/04

[52] U.S. Cl. ..... 123/509; 123/495

[58] Field of Search ..... 123/509, 495, 123/510, 506, 468, 469, 450

[56] References Cited

U.S. PATENT DOCUMENTS 4,418,675 12/1983 Niemeier ..... 123/509
4,526,150 7/1985 Guntert ..... 123/509
5,357,944 10/1994 Rathmayr ..... 123/509
5,398,658 3/1995 Meisimaki ..... 123/509
5,603,303 2/1997 Okajima et al. .

*Primary Examiner*—Carl S. Miller
*Attorney, Agent, or Firm*—Nixon & Vanderhye PC

[57] ABSTRACT

To provide a fuel supply apparatus capable of preventing seizure of a plunger by preventing deformation of a cylinder caused by attaching attachment parts, and capable of being decreased in size, respective attachment parts of a fuel inlet, a delivery valve and a pressure regulator are threadably attached to a housing on a same cross-sectional plane orthogonal to an axis of a high pressure fuel pump, and imaginary extended regions extending seat surfaces of the housing in a direction of attaching thereof, are disposed outside of an outer peripheral surface of a cylinder. Accordingly, even when the attachment parts push the seat surfaces in threadably attaching the respective attachment parts to the housing, almost no axial forces are exerted on the cylinder. Therefore, an inner peripheral surface of the cylinder can be prevented from being deformed, and a sliding clearance between the cylinder and a plunger is prevented from being reduced in size. Therefore, seizure between the cylinder and the plunger is prevented.

8 Claims, 10 Drawing Sheets

FUEL SUPPLY APPARATUS

CROSS REFERENCE TO RELATED APPLICATIONS

This application is based upon and claims priority from Japanese patent application Nos. Hei 9-240822, filed Sep. 5, 1997, and Hei 9-245100, filed Sep. 10, 1997, the entire contents of which are incorporated herein by reference.

BACKGROUND OF THE INVENTION

1. Field of the Invention

The present invention relates to a fuel supply apparatus for supplying high pressure fuel to a fuel injection device of an internal combustion engine.

2. Description of Related Art

One type of known fuel supply apparatus, such as disclosed in Japanese Unexamined Patent Publication No. JP-A-8-14140, has an electromagnetic valve installed in a fuel intake side of a fuel pressurizing chamber. According to the fuel supply apparatus, fuel is sucked into the fuel pressurizing chamber by lowering a plunger when the electromagnetic valve is opened, and the fuel is pressurized by elevating the plunger when the electromagnetic valve is closed. Thus, as shown in FIG. 15, a housing 101 of a high pressure fuel pump 100 is generally coupled with a fuel inlet 110, a delivery valve 111, and a pressure regulator 112 by a threadable attachment radially toward a center of an axis of a plunger 102.

However, according to the structure in which the respective parts are threadably attached to the housing 101 radially toward the center of the axis of the plunger 102, axial forces caused by such threadable attachment are applied to seat surfaces of the housing 101 where the respective attachment parts are fixedly engaged, and accordingly, the axial forces are applied to a cylinder 103. Then, as shown in FIG. 16, the inner peripheral surface of the cylinder 103 having a circular shape shown by a two-dotted chain line 120 before the threadable attachment, is deformed into a shape shown by a bold line 121 after the threadable attachment. That is, a clearance "h" between the plunger 102 and the cylinder 103 which has been uniform in a circumferential direction before the threadable attachment is changed to (h-σ) at portions where the clearance is reduced after the threadable attachment.

When the clearance is partially reduced in this way, as a result of preventing fuel as a lubricant from being sufficiently supplied to the portions where the clearance is reduced, seizing may be caused at sliding portions between the plunger 102 and the cylinder 103, and a reciprocating motion of the plunger 102 may be prevented.

Furthermore, the attachment parts are attached radially to the housing 101, and positions of seat surfaces of the housing 101 for fixedly engaging the respective attachment parts cannot be disposed excessively proximate to the cylinder 103 to prevent deformation of the cylinder 103.

Accordingly, a volume of the housing interposed among the attachment parts is increased, and the housing cannot be reduced in size. Further, since fuel passages for being connected to the respective attachment parts need to be formed respectively, the number of manufacturing process for the fuel passages cannot be reduced.

Furthermore, according to the high pressure fuel pump disclosed in JP-A-8-14140, as shown FIG. 17, when a plunger 102 is lowered in the lower direction in FIG. 17 in accordance with the opening of an electromagnetic valve 210, low pressure fuel is sucked from a fuel intake passage 202 into a fuel pressurizing chamber 204 via a fuel introducing chamber 203, and an opening portion of an electromagnetic valve 210 between a valve member 211 and a valve seat 212.

However, when the number of crests of a cam for reciprocating the plunger 102 is increased and a reciprocating speed of the plunger 102 is increased in order to increase a fuel delivery amount of the high pressure fuel pump 100 per predetermined time period, a fuel intake time period per intake stroke is shortened. The high pressure fuel pump 100 has only one intake path for sucking fuel from the opening portion between the valve member 211 and the valve seat 212 to the fuel pressurizing chamber 204 when the electromagnetic valve 210 is opened. Therefore, a fuel intake failure may result the fuel intake time period is shortened and a necessary fuel amount is not be sucked. It is conceivable to increase a lift amount of the valve member of the electromagnetic valve or to increase an opening area by increasing a seat diameter of the valve member of the electromagnetic valve in order to avoid an intake failure. However, the structure of the conventional electromagnetic valve would need to be changed in a large scale. As a result, there may be an increase in a manufacturing cost because the electromagnetic valve is increased in size. Further, the response of the electromagnetic valve will be lessened in proportion to an increase in size of the electromagnetic valve.

In order to avoid the fuel intake failure accompanied by shortened fuel intake time period, a high pressure fuel pump 220 as shown in FIG. 18 may be provided. In the case where the plunger 102 is lowered when the electromagnetic valve 210 is opened, low pressure fuel is sucked into the fuel pressurizing chamber 204 from a fuel intake passage 221 via the fuel introducing chamber 203 and the opening portion between the valve member 211 and the valve seat 212. Furthermore, when the plunger 102 is lowered to a position shown in FIG. 18, low pressure fuel is sucked into the fuel pressurizing chamber 204 directly from a fuel intake passage 222. Therefore, it has two intake paths for fuel intake and accordingly, it is intended to prevent a reduction in the fuel intake amount per intake stroke, and to increase the fuel delivery amount per predetermined time period even if the fuel intake time period is shortened.

However, a pressurized transferring of fuel is not started unless an outer wall of the plunger 102 closes the fuel intake passage 222 in accordance with the elevation of the plunger 102. Further, since the fuel intake passage 222 is closed by the outer wall of the plunger 102 in the pressurized transferring stroke, fuel cannot be sufficiently pressurized unless the plunger 102 is further elevated to ensure a sufficient seal length for the fuel intake passage 222 after closing the fuel intake passage 222 by the plunger 102. Accordingly, a fuel delivery amount in respect of a volume of the fuel pressurizing chamber 204 when the plunger 102 reaches the bottom dead point, that is, the fuel delivery efficiency, may be lessened.

SUMMARY OF THE INVENTION

The present invention was made in light of the foregoing problems, and it is an object of the present invention to provide a fuel supply apparatus capable of avoiding seizure of a plunger by preventing a cylinder deformation accompanied by attaching attachment parts, and capable of being reduced in size.

It is another object of the present invention to provide a fuel supply apparatus capable of reducing the number of manufacturing processes.

It is another object of the present invention to provide a fuel supply apparatus capable of increasing a fuel delivery amount per predetermined time period with a simple structure without increasing its size.

According to a fuel supply apparatus of the present invention, imaginary extended region, which is extending a seat surface of a housing in a direction of attaching thereof, is located outside of an inner peripheral surface of a cylinder. Therefore, almost no axial force caused by attaching an attachment member is applied to the inner peripheral surface of the cylinder when the attachment member is attached to the housing. Therefore, the inner peripheral surface of the cylinder is not deformed, and accordingly, a sliding clearance between the plunger and the cylinder is maintained substantially constant and seizure between the plunger and the cylinder is prevented.

Further, so far as the imaginary extended region of the seat surface is disposed outside of the inner peripheral surface of the cylinder, the attachment parts can be made as proximate to the inner peripheral surface of the cylinder as possible, and accordingly, the housing is reduced in size, and the apparatus can be made light-weighted.

According to another aspect of the present invention, at least two of the attachment members, which are opposing each other, are is connected to a fuel passage having a uniform fuel pressure. Therefore, the fuel passage connected to the opposite attachment members can be constituted by a single fuel passage. Accordingly, the number of manufacturing processes of the fuel passage is reduced.

According to another aspect of the present invention, a securing direction of the attachment member is parallel with a line extending between axial centerlines of the cylinder and a constraint portion defined by the housing for receiving a retainer to affix the fuel supply apparatus. Therefore, the attachment parts can be attached to the constraint position as proximate as possible. Accordingly, the deformation of the cylinder in attaching the attachment parts can be prevented. Furthermore, the number of directions for connecting fuel pipes connected to the attachment parts is at most two, and therefore, the arrangement and connection of the fuel pipes are facilitated. Furthermore, by attaching the respective attachment parts to the housing in parallel and put together, a volume of the housing filling gaps among the respective attachment parts is reduced. Therefore, the housing and the apparatus are reduced in size.

According to another aspect of the present invention, a first fuel intake path to intake low pressure fuel from a fuel introducing chamber into a fuel pressurizing chamber via an electromagnetic valve, and a second fuel intake path to intake the low pressure fuel from a fuel intake passage into the fuel pressurizing chamber via a check valve. Since there are two fuel intake paths leading to the fuel pressurizing chamber, even if the reciprocating speed of the plunger is increased by an increase in the number of crests of a cam or the like, a necessary fuel intake amount per intake stroke can be ensured by a simple constitution, and an increase in the manufacturing cost is prevented without increasing the size of the apparatus.

Furthermore, when the plunger is elevated, the electromagnetic valve is closed and the fuel in the fuel pressurizing chamber is pressurized, and a check valve installed in the fuel intake passage is closed. Therefore, the pressurized transferring stroke is swiftly started in accordance with closing of the electromagnetic valve. Therefore, the fuel delivery amount per predetermined time period is increased.

According to another aspect of the present invention, the fuel introducing chamber is located adjacent to the electromagnetic valve, and the fuel intake passage is connected to the fuel introducing chamber. Thus, a solenoid of the electromagnetic valve is cooled because an intake fuel which has a comparatively low temperature flows in the fuel introducing chamber toward the fuel intake passage. Therefore, an operational failure of the electromagnetic valve caused by a temperature rise is prevented.

According to another aspect of the present invention, the fuel intake passage has an opening at a non-sliding portion of the cylinder. Accordingly, the fuel intake passage is not closed regardless of a position of the plunger. Therefore, sufficient fuel amount can be sucked from the fuel intake passage in accordance with lowering of the plunger.

BRIEF DESCRIPTION OF THE DRAWINGS

Other features and advantages of the present invention will be appreciated, as well as methods of operation and the function of the related parts, from a study of the following detailed description, the appended claims, and the drawings, all of which form a part of this application. In the drawings:

DETAILED DESCRIPTION OF THE PREFERRED EMBODIMENTS

Embodiments of the present invention will be described hereinafter with reference to the drawings.

(First Embodiment)

A first embodiment of the present invention is shown in FIGS. 1 through 4. as a high pressure fuel pump 1. The high pressure fuel pump 1 sucks fuel at a low pressure scooped up from a fuel tank, not illustrated, by a low pressure fuel pump, not illustrated, and supplies fuel at a high pressure pressurized by the high pressure fuel pump 1 to a distribution pipe, not illustrated. The distribution pipe is attached with injectors for several cylinders constituting a fuel injection apparatus. A housing 11 of the high pressure fuel pump 1 are fastened to an engine by bolts at two locations of constraint positions 11*a* indicated by FIG. 1.

Figure 2:
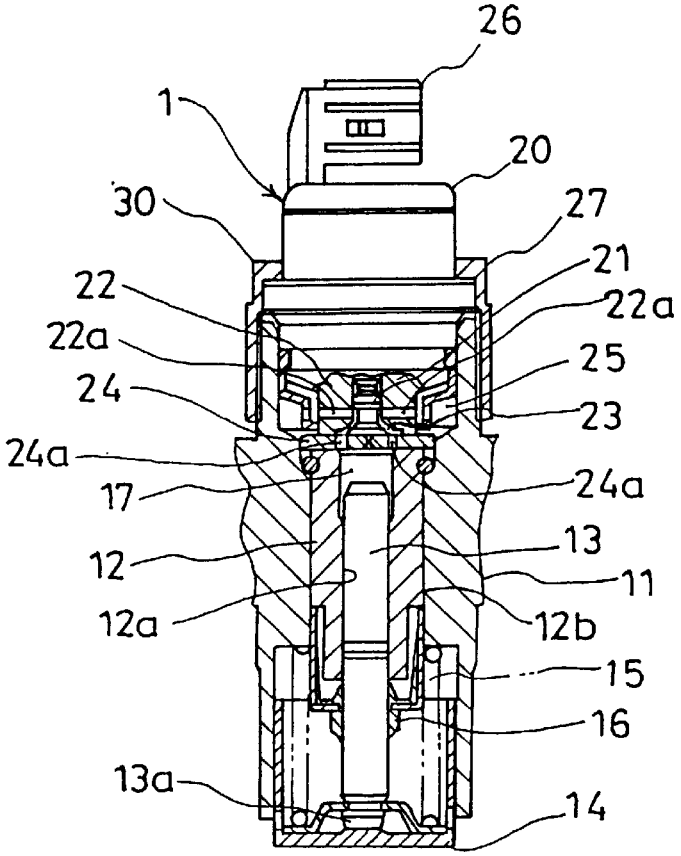
FIG. 2 is a part of a longitudinal sectional view of the high pressure fuel pump taken along a line II—II in FIG. 3 according to the first embodiment of the present invention.

As shown in FIG. 2, a cylinder 12 constituting a cylinder unit is fixed at an inside of the housing 11 of the high pressure fuel pump 1. The cylinder 12 reciprocatably supports a plunger 13 and is brought into sliding contact with the plunger 13 at an inner peripheral surface 12*a* constituting a sliding surface. A head 13*a* of the plunger 13 is fixed to a tappet 14 in a shape of a bottomed cylinder and the plunger 13 is reciprocated along with the tappet 14. The tappet 14 is urged in the lower direction of FIG. 2 by a spring 15 and the plunger 13 and the tappet 14 are driven to reciprocate by a cam 91 shown in FIG. 4. An outer peripheral wall of the plunger 13 is sealed by a seal member 16 made of rubber at outside of the cylinder 12.

A fuel pressurizing chamber 17 is formed at an end portion of the plunger 13 by an inner wall of the cylinder 12. The fuel at a low pressure sucked into the fuel pressurizing chamber 17 by lowering the plunger 13, is pressurized by elevating the plunger 13.

An electromagnetic valve 20 is attached to an upper side of the housing 11 by a retaining nut 27. A valve member 21 is reciprocatably supported by a valve body 22 and is urged in an opening direction by a spring, not illustrated. The valve body 22 is formed with a plurality of communication holes 22*a* in the diameter direction and the communication holes 22*a* communicate a store hole for storing the valve member 21 with an annular fuel chamber 25 formed on the outer side of the valve body 22. The movement of the valve member 21 in the opening direction is restricted by a seat plate 24. The seat plate 24 is formed with communication holes 24*a* penetrating the seat plate 24.

Control current is supplied from an engine control unit (ECU), not illustrated, to a solenoid unit, not illustrated, of the electromagnetic valve 20 via a connector 26 and the electromagnetic valve 20 is opened and closed by making ON and OFF the control current. When the electromagnetic valve 20 is opened by making OFF electricity conduction to the solenoid unit, the annular fuel chamber 25 communicates with the fuel pressurizing chamber 17 via the communication holes 22*a*, an opening portion between the valve member 21 and the valve seat 23 and the communication holes 24*a*. When electricity is conducted to a solenoid unit, not illustrated, the valve member 21 is drawn against urging force of a spring and is seated on the valve seat 23. Thereby, communication between the annular fuel chamber 25 and the fuel pressurizing chamber 17 is cut.

Figure 1:
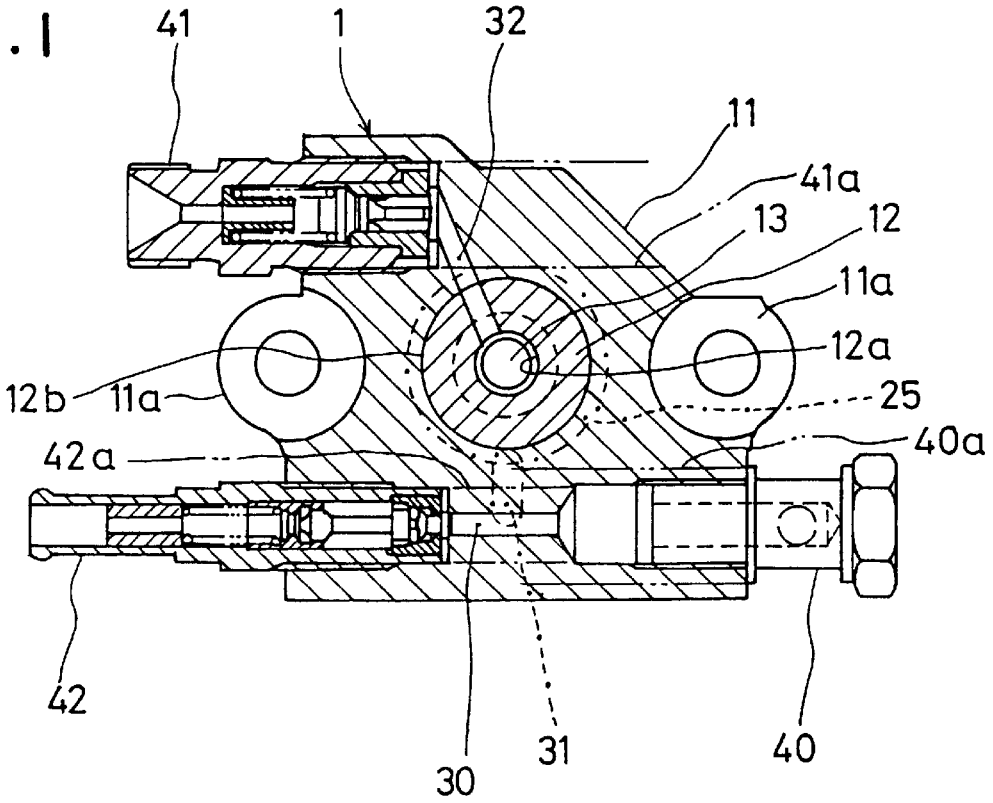
FIG. 1 is a transverse sectional view of a high pressure fuel pump taken along a line I—I in FIG. 4 according to a first embodiment of the present invention.
Figure 3:
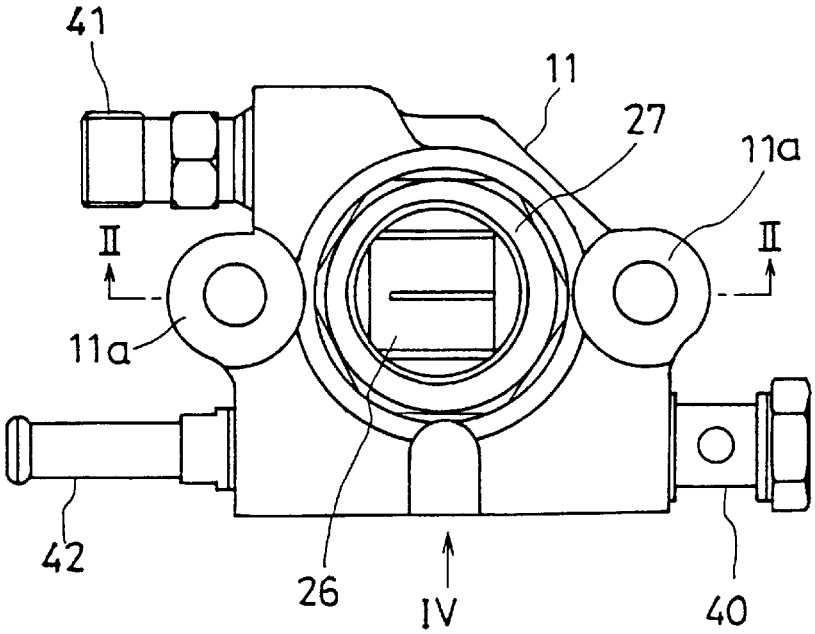
FIG. 3 is a top plan view of the high pressure fuel pump according to the first embodiment of the present invention.
Figure 4:
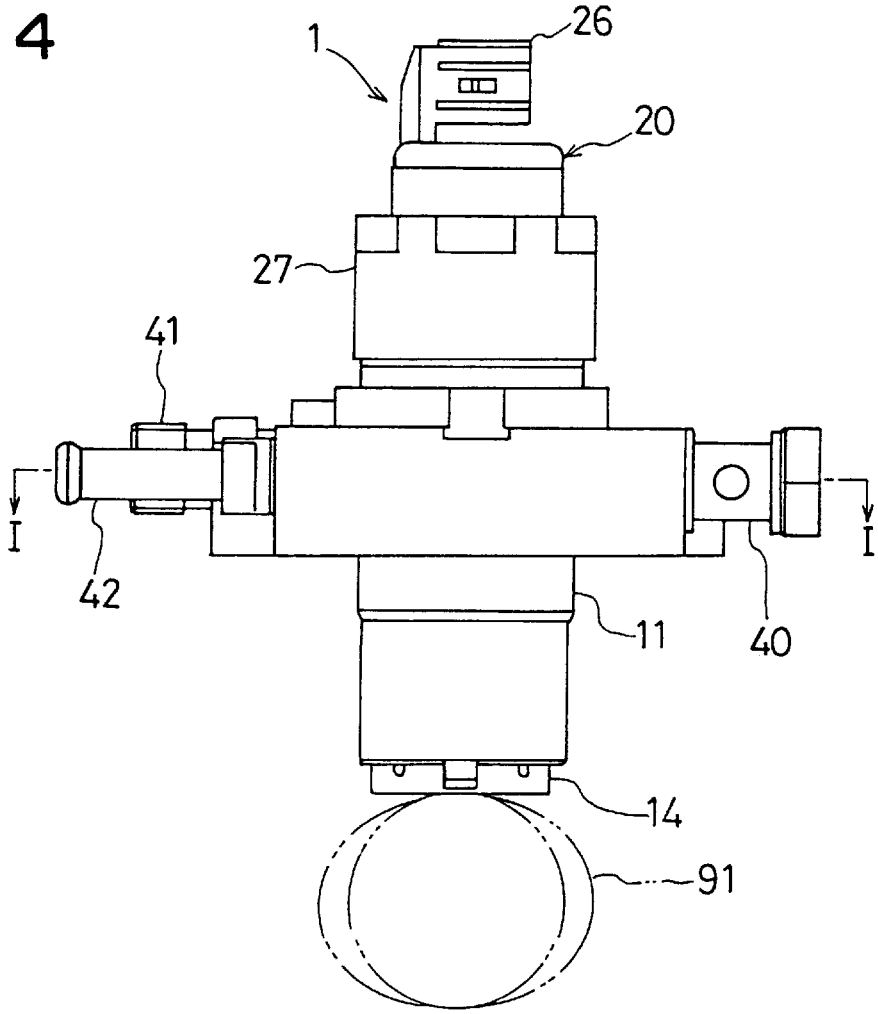
FIG. 4 is a side view of the high pressure fuel pump viewed from an arrow IV in FIG. 3 according to the first embodiment of the present invention.

As shown by FIG. 1, FIG. 3 and FIG. 4, a fuel inlet 40, a delivery valve 41 and a pressure regulator 42 as attachment parts are threadably attached to the housing 11 in a same cross-sectional plane which is orthogonal to an axis of the high pressure fuel pump 1. Further, as shown by FIG. 1, the fuel inlet 40, the delivery valve 41 and the pressure regulator 42 are threadably attached to the housing 11 in parallel with an imaginary line extending between axial center lines of one of the constraint positions 11*a* and the plunger 13. Further, imaginary extended regions 40*a*, 41*a* and 42*a* extending seat surfaces of the housing 11 fixedly engaged with the respective attachment parts in directions of attaching thereof, are disposed outside of an outer peripheral surface 12*b* of the cylinder 12 (In other words, the imaginary extended regions 40*a*, 41*a* and 42*a* are skewed or parallel with the cylinder 12). Regarding the fuel inlet 40, the seat surface is an outer peripheral wall of the housing 11 in contact with the fuel inlet 40. Regarding the delivery valve 41 and the pressure regulator 42, the seat surfaces are bottom portions of threaded holes formed on the housing 11.

The fuel inlet 40 and the pressure regulator 42 are connected to a single one of a fuel intake passage 30 which is a low pressure fuel passage oppositely to each other. The fuel intake passage 30 is communicated with the annular fuel chamber 25 by a fuel intake passage 31. The pressure regulator 42 is opened when pressure of fuel introduced from the fuel intake passage 30 into the annular fuel chamber 25 is a predetermined pressure or higher and returns extra fuel back to the fuel tank, not illustrated, to thereby prevent fuel pressure in the annular fuel chamber 25 from being the predetermined pressure or higher.

A fuel delivery passage 32 connects the fuel pressurizing chamber 17 with the delivery valve 41 and the delivery valve 41 is opened when pressure of fuel in the fuel pressurizing chamber 17 becomes a predetermined pressure or higher by which fuel at a high pressure is pressurized to a distribution pipe, not illustrated.

Next, an explanation will be given of the operation of the high pressure fuel pump 1.

(1) Intake stroke

When electricity conduction to a solenoid unit is made OFF, the valve member 21 is detached from the valve seat 23 and the electromagnetic valve 20 is opened. When the plunger 13 is lowered toward the bottom dead center under the state, the volume of the fuel pressurizing chamber 17 is increased and accordingly, fuel at a low pressure is sucked from the annular fuel chamber 25 to the fuel pressurizing chamber 17 via the communication holes 22*a*, the opening portion between the valve member 21 and the valve seat 23 and the communication holes 24*a*.

(2) Pressurized transferring stroke

When the plunger 13 reaches to a position in correspondence with a desired fuel delivery amount in the stroke where the plunger 13 reaches the bottom dead center and is thereafter elevated toward the top dead center, electricity conduction to the solenoid unit is made ON. When the valve member 21 is seated on the valve seat 23 by magnetic force generated by conducting electricity to the solenoid portion against the urging force of the spring and the electromagnetic valve 20 is opened, communication between the annular fuel chamber 25 and the fuel pressurizing chamber 17 is cut. When the plunger 13 is further elevated, fuel in the fuel pressurizing chamber 17 is pressurized. When fuel pressure in the fuel pressurizing chamber 17 becomes a predetermined pressure or higher, the delivery valve 41 is opened, fuel at a high pressure is delivered from the fuel delivery passage 32 and is pressurized to a distribution pipe. Fuel at a high pressure pressurized to the distribution pipe is injected from injectors at predetermined timing.

According to the first embodiment, the imaginary extended regions 40*a*, 41*a* and 42*a* extending the seat surfaces of the housing 11 fixedly engaged with the fuel inlet 40, the delivery valve 41 and the pressure regulator 42 constituting the attachment parts, are disposed outside of the outer peripheral surface 12*b* of the cylinder 12. Therefore, even when the attachment parts are pushed to the seat surfaces in threadably attaching the respective attachment parts to the housing 11, almost no axial forces thereof are exerted on the cylinder 12. Thereby, the inner peripheral surface 12*a* of the cylinder 12 can be prevented from being deformed and the sliding clearance can be prevented from becoming small and accordingly, seizure between the cylinder 12 and the plunger 13 can be prevented. Further, fuel at a high pressure can be prevented from leaking from the fuel pressurizing chamber 17 by passing through the sliding portions of the cylinder 12 and the plunger 13 by enlarging the sliding clearance.

Further, the attachment parts are threadably attached to the housing 11 in parallel with a perpendicular fallen from either of the two locations of constraint positions 11*a* to a center of an axis of the plunger 13 and accordingly, a volume of the housing 11 filling intermediaries of the respective attachment parts is reduced, the housing 11 is small-sized and light-weighted.

Further, the fuel inlet 40 and the pressure regulator 42 are connected to a single one of the fuel intake passage 30 which is a low pressure fuel passage oppositely to each other, and accordingly, it is not required to form fuel passages for each fuel inlet 40 and the pressure regulator 42, and the number of steps of fabricating fuel passages is reduced.

(Second Embodiment)

Figure 5:
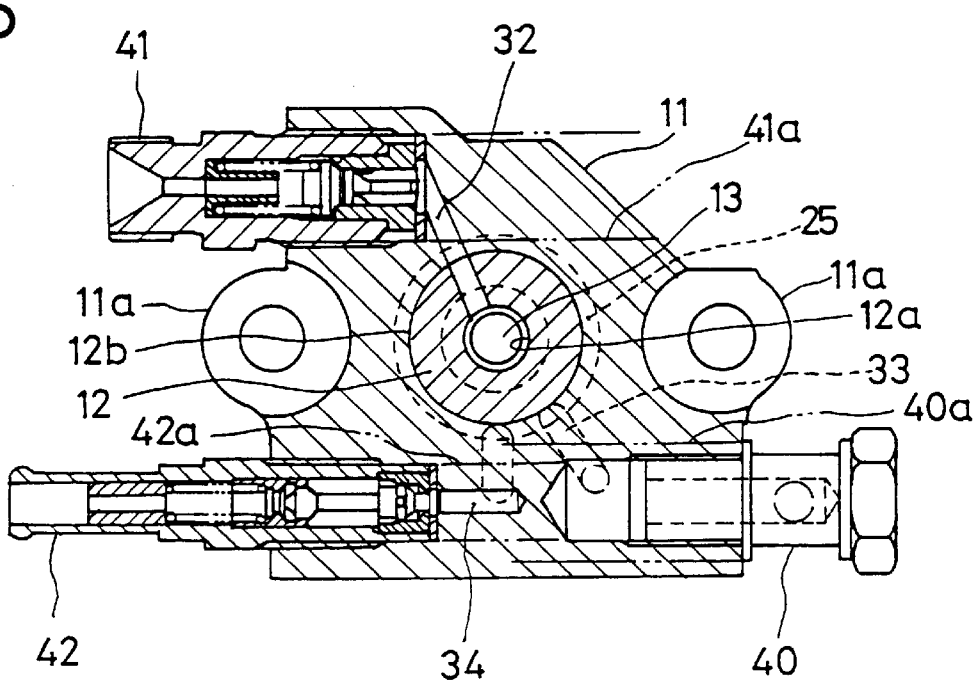
FIG. 5 is a transverse sectional view of a high pressure fuel pump according to a second embodiment of the present invention.

FIG. 5 shows a second embodiment of the present invention. In this and the following embodiments, components which are substantially the same to those in previous embodiments are assigned the same reference numerals.

According to the second embodiment, the fuel inlet 40 and the pressure regulator 42 are not connected to a common fuel intake passage but connected to the annular fuel chamber 25 via fuel intake passage 33 and fuel exhaust or return passage 34, respectively.

(Third Embodiment)

Figure 6:
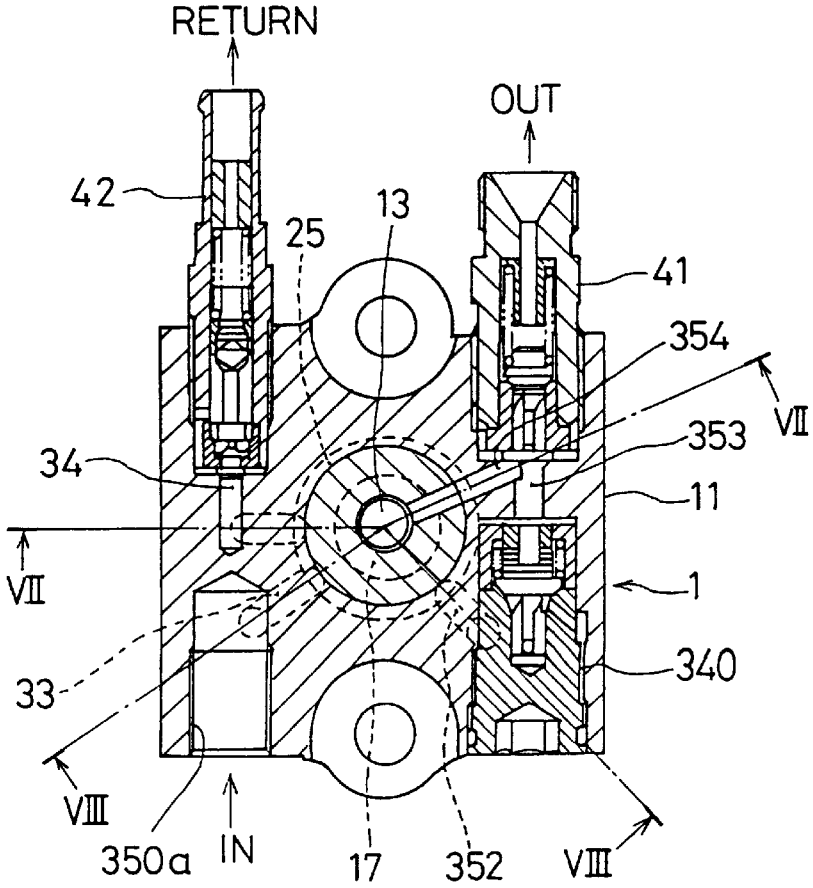
FIG. 6 is a transverse sectional view of a high pressure fuel pump according to a third embodiment of the present invention.
Figure 7:
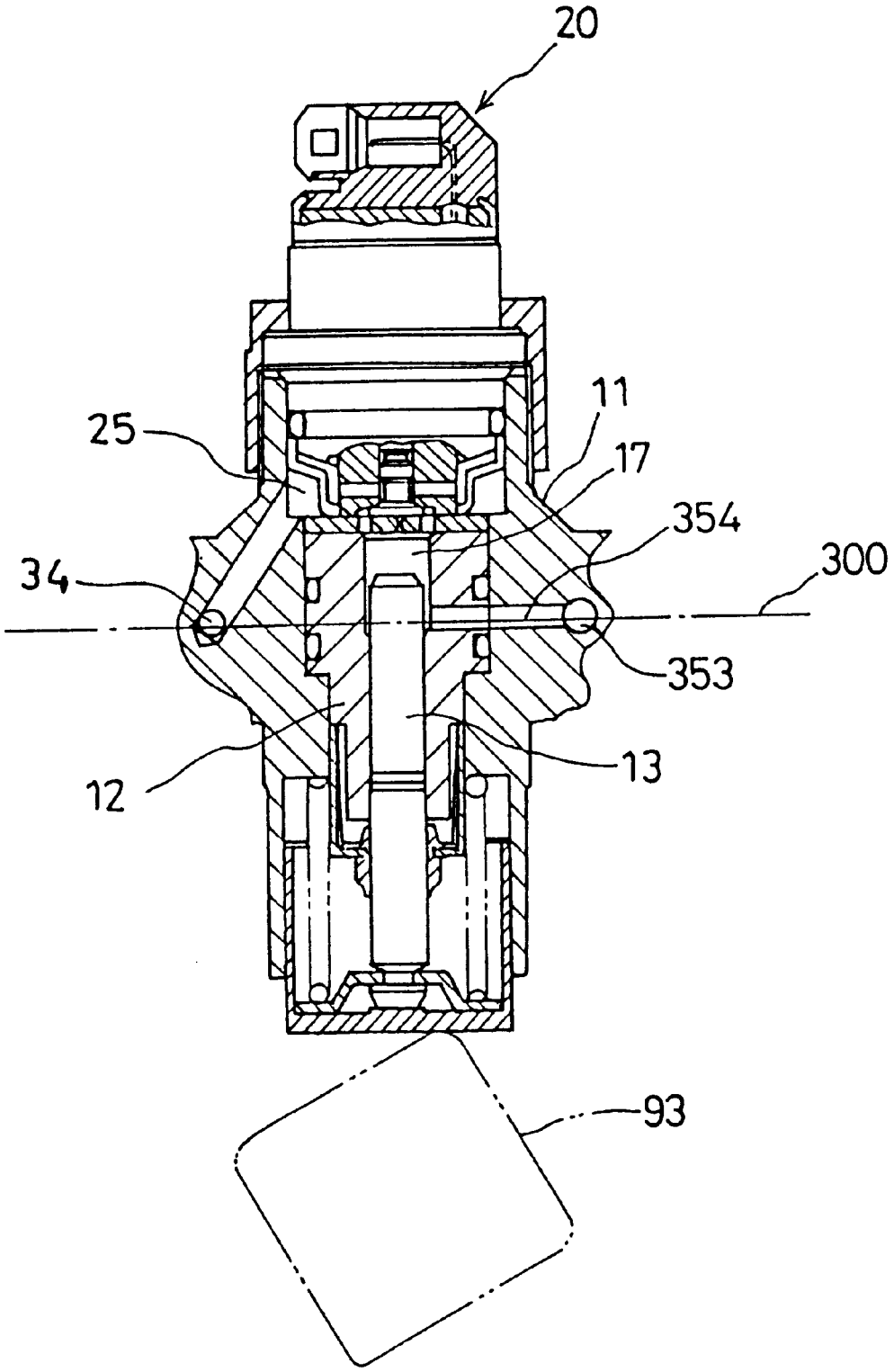
FIG. 7 is a part of a sectional view of the high pressure fuel pump taken along a line VII—VII in FIG. 6 according to the third embodiment of the present invention.
Figure 8:
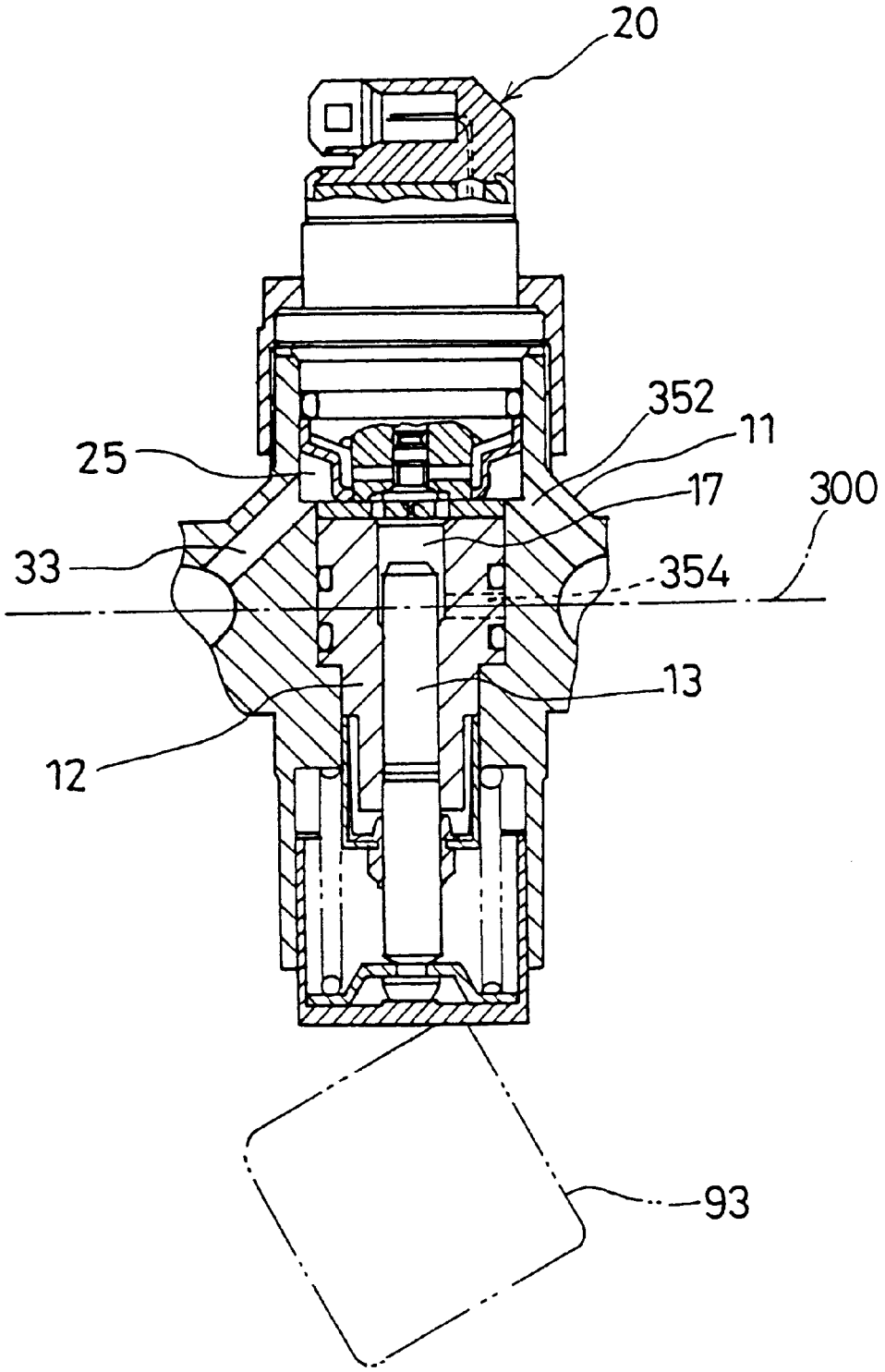
FIG. 8 is a part of a sectional view of the high pressure fuel pump taken along a line VIII—VIII in FIG. 6 according to the third embodiment of the present invention.

A third embodiment of the present invention is shown in FIGS. 6 through 8.

A cam 93 for driving a high pressure fuel pump 1 has four crests.

As shown in FIG. 6, a fuel inlet 350*a*, a check valve 340, the delivery valve 41 and the pressure regulator 42 are formed or installed in the housing 11 on a cross-sectional face of the high pressure fuel pump 1 including an imaginary straight line 300 shown in FIGS. 7 and 8. Furthermore, the fuel inlet 350*a* at the low pressure side and the pressure regulator 42 are opposed to each other. The high pressure side of the check valve 340 and the delivery valve 41 are opposed to each other. The fuel inlet 350*a* and the check valve 40 are formed or attached in parallel each other. The delivery valve 41 and the pressure regulator 42 are formed or attached in parallel with each other. Accordingly, fuel pipes can be installed in the same direction, and therefore, the attachment of the fuel pipes is facilitated. Furthermore, since a volume of housing around the fuel inlet 350*a* and the respective valves is reduced, the high pressure fuel pump 1 is reduced in size.

Imaginary extended regions of a seat face for attaching the fuel pipe connected to the fuel inlet 350*a* to the housing 11 and seat faces for attaching the check valve 340, the delivery valve 41 and the pressure regulator 42 to the housing 11, are located outside, in a radial direction of the plunger 13, of the sliding portion between the plunger 13 and the cylinder 12. Accordingly, axial forces in fastening the fuel pipe or the respective valves by threadably attaching to the housing 11 are not exerted on the sliding portion between the plunger 13 and the cylinder 12. Therefore, the deformation of the sliding face of the cylinder 12 can be prevented, and accordingly, a slide clearance between the cylinder 12 and the plunger 13 can be maintained constant. Accordingly, the seizure between the cylinder 12 and the plunger 13 can be prevented.

A fuel intake passage 352 connects the annular fuel chamber 25 with the check valve 340, and a fuel intake passage 353 connects the check valve 340 with the delivery valve 41, and a fuel intake passage 354 connects the delivery valve 41 with the fuel pressurizing chamber 17. The fuel intake passages 352, 353 and 354 constitute a second intake path. Since the fuel intake passage 354 also functions as the fuel delivery passage, a number of manufacturing process for forming the fuel passages is reduced.

(Fourth Embodiment)

Figure 9:
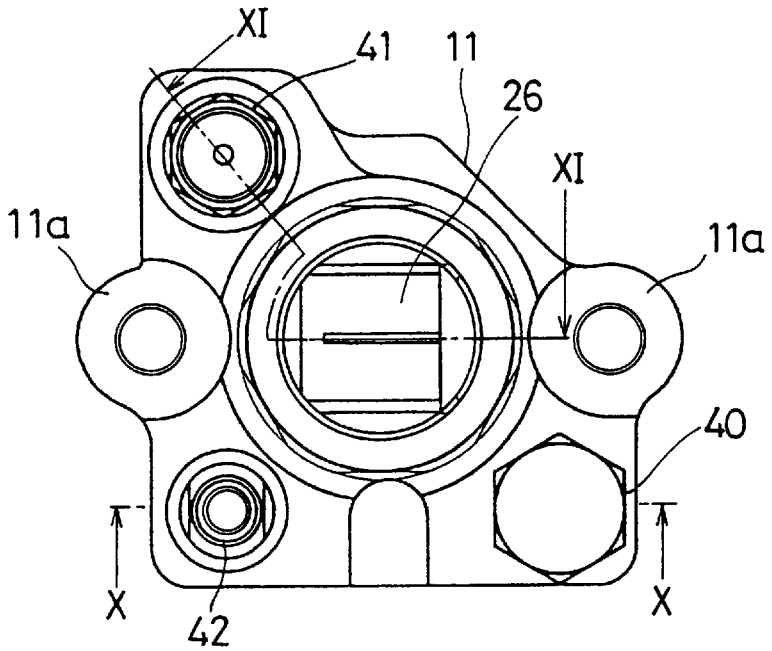
FIG. 9 is a top plan view of a high pressure fuel pump according to a fourth embodiment of the present invention.
Figure 10:
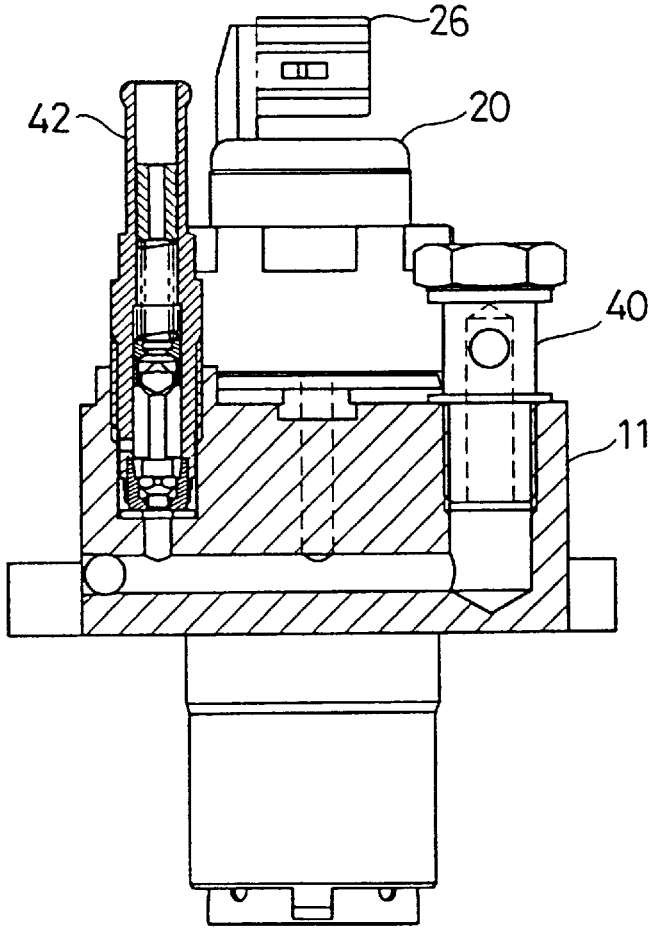
FIG. 10 is a part of a partially sectional view of the high pressure fuel pump taken along a line X—X in FIG. 9 according to the fourth embodiment of the present invention.
Figure 11:
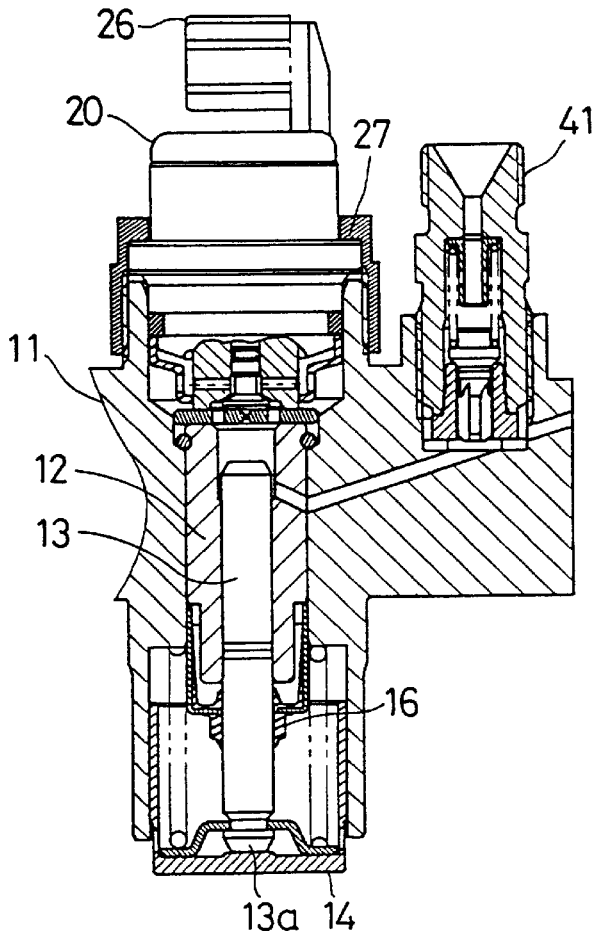
FIG. 11 is a part of a partially sectional view of the high pressure fuel pump taken along a line XI—XI in FIG. 9 according to the fourth embodiment of the present invention.

A fourth embodiment of the present invention is shown in FIGS. 9 through 11.

In the fourth embodiment of the present invention, the fuel inlet 40, the delivery valve 41 and the pressure regulator 42 are threadably attached to the housing 11 such that the longitudinal direction (screwing direction) of the fuel inlet 40, the delivery valve 41 and the pressure regulator 42 is parallel with the axial (longitudinal) direction of the plunger 13.

According to the fourth embodiment of the present invention, the high pressure fuel pump is reduced in size in its radial direction.

According to the above-described embodiments of the present invention, the imaginary extended regions 40*a*, 41*a* and 42*a* extending the seat surfaces of the housing 11 fixedly engaged with the fuel inlet 40, the delivery valve 41 and the pressure regulator 42 constituting the attachment parts in directions of attaching thereof, are disposed outside of the outer peripheral surface 12*b* of the cylinder 12. Accordingly, axial forces of the attachment parts pushing the seat surfaces in threadably attaching to the housing 11, are not exerted on the inner peripheral surface 12*a* of the cylinder 12 sliding with the plunger 13. Thereby, the inner peripheral surface 12*a* of the cylinder 12 is not deformed and therefore, the sliding clearance between the plunger 13 and the cylinder 12 can be maintained substantially constant and seizure between the plunger 13 and the cylinder 12 can be prevented.

Furthermore, the attachment parts can be disposed as proximate to the center of the axis of the plunger 13 as possible within a range where axial forces of the attachment parts threadably attached to the housing 11 are exerted to at least outside of the outer peripheral surface 12*b* of the cylinder 12. Furthermore, the attachment parts are attached to the housing 11 in parallel with a perpendicular fallen from either of the two locations of the constraint positions 11*a* where the high pressure fuel pump is attached to the engine, toward the central axis of the plunger 13 and accordingly, the respective parts can be threadably attached to the housing 11 to aggregate in parallel with each other. Accordingly, a volume of housing filling intermediaries of the respective attachment parts can be reduced and configuration of the housing 11 can be downsized.

Furthermore, the number of direction of connecting fuel pipes connected to the attachment parts is at most two and accordingly, arrangement and connection of fuel pipes are facilitated and mounting thereof to the engine is facilitated.

Further, the attachment parts can be attached to the housing 11 as proximate to the constraint positions 11*a* as possible and therefore, even when the attachment parts are threadably attached to the housing 11, the housing per se becomes difficult to deform.

Although according to the plurality of examples, the attachment parts are threadably attached to the housing 11, the method of attaching thereof is not limited to the threadable attachment but the attachment parts may be attach to the housing by using fixing members of clamps or the like.

Further, although according to the plurality of examples, the imaginary extended regions 40*a*, 41*a* and 42*a* are constituted to dispose outside of the outer peripheral surface 12*b* of the cylinder 12, by constituting the imaginary extended regions to dispose at least outside of the inner peripheral surface 12*a* of the cylinder 12, deformation of the inner peripheral surface 12*a* in attaching the attachment parts to the housing 11 can be reduced.

Although according to the above-described embodiments, two locations of the constraint positions 11*a* are provided, the constraint positions 11*a* may be provided at three locations or more. Also in this case, by attaching the attachment parts to aggregate in the housing 11 in parallel with a perpendicular fallen from either one location of the constraint positions 11*a* toward the central axis of the plunger 13, the housing 11 can be reduced in size.

Although the housing 11 and the cylinder 12 are constituted by separate members in the above-described embodiments, the housing and the cylinder may be integrally formed with each other. In this case, the seizure between the cylinder portion and the plunger can be prevented by locating the imaginary extended regions, which are extending the seat surfaces of the housing in directions of threadably attaching attachment parts to the housing, outside the inner peripheral surface of the cylinder unit sliding with the plunger.

(Fifth Embodiment)

Figure 12:
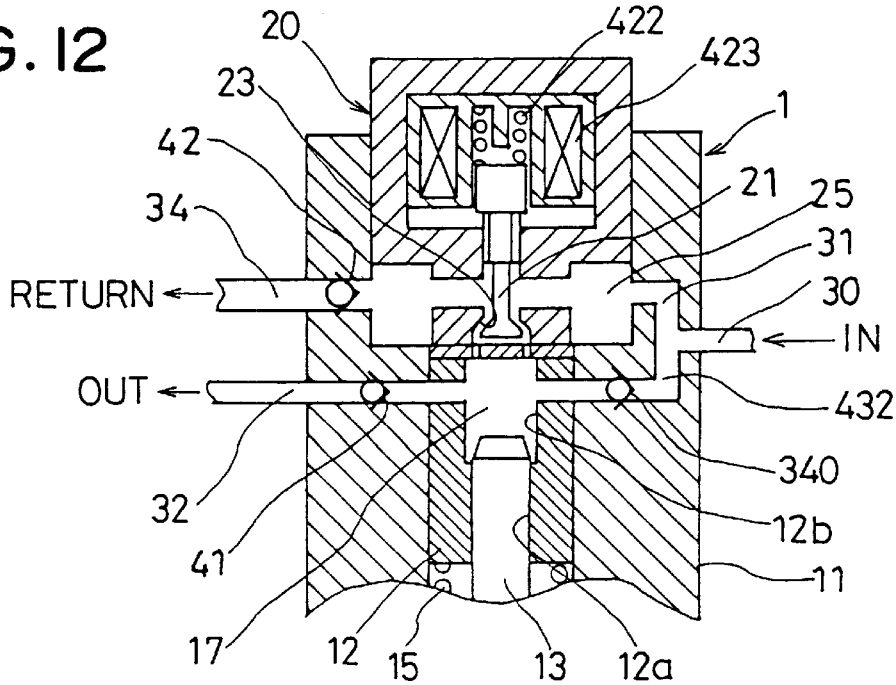
FIG. 12 is a part of a longitudinal sectional view of a high pressure fuel pump according to a fifth embodiment of the present invention.

A fifth embodiment of the present invention is shown in FIG. 12.

The high pressure fuel pump 1 sucks fuel at a low pressure which is scooped up from a fuel tank (not illustrated) by a low pressure pump (not illustrated), and supplies fuel at a high pressure pressurized by the high pressure fuel pump 1 to a distribution pipe (not illustrated). Several injectors, as a fuel injection device, having the same number of cylinders of an engine are installed in the distribution pipe.

A cylinder 12 constituting a cylinder unit is fixed in a housing 11 of the high pressure fuel pump 1. A small diameter portion 12*a* of the cylinder 12 slides with a plunger 13, and the small diameter portion 12*a* reciprocatably supports the plunger 13. The plunger 13 is biased toward the lower direction in FIG. 12 by a spring 15, and is driven to reciprocate by a cam (not illustrated) having, for example, four crests, which is disposed on the lower side in FIG. 12.

The fuel pressurizing chamber 17 is formed at an end portion of the plunger 13 by an inner wall of the cylinder 12. The low pressure fuel is sucked into the fuel pressurizing chamber 17 by lowering the plunger 13, and is pressurized by elevating the plunger 13.

An electromagnetic valve 20 is located on the upper portion of the housing 11, and an annular fuel chamber 25, as a fuel introducing chamber, is formed between the electromagnetic valve 20 and the housing 11. When current is not supplied to a solenoid 423, a valve member 21 is biased toward the lower direction in FIG. 12 by a spring 422 to keep the electromagnetic valve 20 in opened state. At this moment, the annular fuel chamber 25 is communicated with the fuel pressurizing chamber 17. A path, for sucking the low pressure fuel from the annular fuel chamber 25 to the fuel pressurizing chamber 17 via an opening portion of the electromagnetic valve 20 when the electromagnetic valve 20 is opened, constitutes a first intake path. When current is supplied to the solenoid 423, the valve member 21 is attracted upwardly against the spring force of the spring 422, and is seated on a valve seat 23. Then, communication between the annular fuel chamber 25 and the fuel pressurizing chamber 17 is stopped.

A fuel intake passage 30 is branched into a fuel intake passage 31 and a fuel intake passage 432. The fuel intake passage 31 is communicated with the annular fuel chamber 25. The fuel intake passage 432 is communicated with the fuel pressurizing chamber 17 by being opened to a large diameter portion 12*b*, which does not have a sliding contact with the plunger 13, of the cylinder 12. A check valve 340, for preventing reversed fuel flow from the fuel pressurizing chamber 17 to the fuel intake passage 432, is installed in the fuel intake passage 432. A path, for sucking the low pressure fuel from the fuel intake passage 432 to the fuel pressurizing chamber 17 via an opening portion of the check valve 340, constitutes a second intake path. Since the large diameter portion 12*b* of the cylinder 12 has a greater diameter than the small diameter portion 12*a*, the large diameter portion 12*b* does not have a sliding contact with the plunger 13. Accordingly, the fuel intake passage 432 is not closed by the plunger 13 even when a rise side end face of the plunger 13 is located higher than the fuel intake passage 432 in FIG. 12.

The fuel delivery passage 32 is communicated with the fuel pressurizing chamber 17, and the delivery valve 41 is installed in the fuel delivery passage 32. The delivery valve 41 is opened when a fuel pressure in the fuel pressurizing chamber 17 is higher than a predetermined pressure, and high pressure fuel is supplied from the fuel delivery passage 32 to the distribution pipe (not shown).

A fuel exhaust passage 34 is communicated with the annular fuel chamber 25, and the pressure regulator 42 is installed in the fuel exhaust passage 34. The pressure regulator 42 is opened and returns extra fuel to a fuel tank (not illustrated) to keep the fuel pressure in the annular fuel chamber 25 necessary pressure, when a pressure of fuel introduced from the fuel intake passage 31 to the annular fuel chamber 25 becomes higher than a predetermined pressure.

Next, an operation of the high pressure fuel pump 1 will be explained below.

(1) Intake stroke

When current is not supplied to the solenoid 423, the valve member 21 stays detached from the valve seat 23, and the electromagnetic valve 20 is opened. When the plunger 13 is lowered toward the bottom dead center under the above state, the volume of the fuel pressurizing chamber 17 is increased. Accordingly, the low pressure fuel is sucked into the fuel pressurizing chamber 17 via two paths of (1) a path passing through an opening portion between the valve member 21 and the valve seat 23 from the annular fuel chamber 25 and (2) a path passing through the fuel intake passage 432. During the intake stroke, the check valve 340 is opened.

(2) Pressurizing and transferring stroke

After the plunger 13 reaches the bottom dead center and when the plunger 13 reaches a position in correspondence with a desired fuel delivery amount in the stroke of elevating toward the top dead center, current is supplied to the solenoid 423. When the valve member 21 is lifted against the spring force of the spring 422 and is seated on the valve seat 23 by magnetic force generated by the solenoid 423 to close the electromagnetic valve 20, the communication between the annular fuel chamber 25 and the fuel pressurizing chamber 17 is stopped. When the plunger 13 is further elevated, the check valve 340 is closed, and fuel in the fuel pressurizing chamber 17 is pressurized in accordance with the elevation of the plunger 13. When fuel pressure in the fuel pressurizing chamber 17 becomes higher than a predetermined pressure, the delivery valve 41 is opened, and the high pressure fuel is delivered from the fuel delivery passage 32 and delivered to the distribution pipe.

According to the fifth embodiment of the present invention, in addition to the first intake path for sucking low pressure fuel from the annular fuel chamber 25 to the fuel pressurizing chamber 17 via the opening portion between the valve member 21 and the valve seat 23 when the electromagnetic valve 20 is opened, the second intake path for directly sucking the low pressure fuel from the fuel intake passage 432 to the fuel pressurizing chamber 17 via the opening portion of the check valve 340 is installed. Accordingly, even when the reciprocating speed of the plunger 13 is increased by increasing the number of crests of a cam in order to increase the fuel delivery amount per predetermined time period, a necessary fuel amount in one intake stroke can be sucked. Furthermore, the fuel delivery amount can be increased with the simple structure that the fuel intake passage 432 being communicated with the fuel pressurizing chamber 17 is added and the check valve 340 is installed in the fuel intake passage 432. Therefore, the manufacturing cost can be restrained without increasing the size of the high pressure fuel pump.

(Sixth Embodiment)

Figure 13:
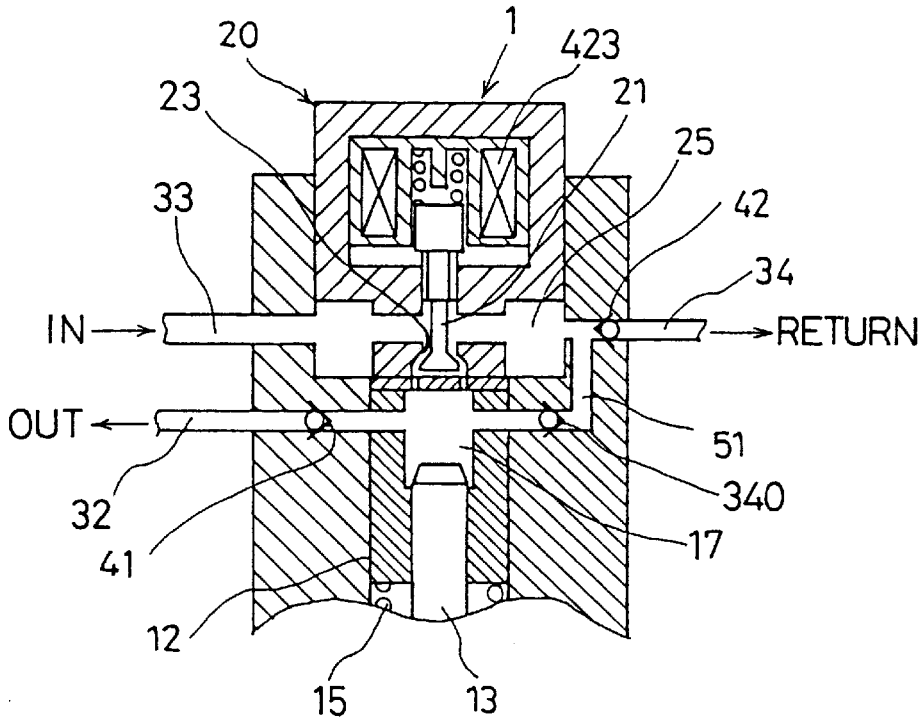
FIG. 13 is a part of a longitudinal sectional view of a high pressure fuel pump according to a sixth embodiment of the present invention.

A sixth embodiment of the present invention is shown in FIG. 13.

A fuel intake passage 33 is communicated with the annular fuel chamber 25. A fuel intake passage 51 is communicated with the annular fuel chamber 25 on a side thereof substantially opposite, in a radial direction, to a connecting portion between the fuel intake passage 50 and the annular fuel chamber 25. The check valve 340 is installed in the fuel intake passage 51. A path, for sucking the low pressure fuel from the fuel intake passage 51 to the fuel pressurizing chamber 17 via the opening portion of the check valve 340, constitutes the second intake path.

According to the sixth embodiment of the present invention, fuel passing through the annular fuel chamber 25 is constituted by fuel sucked into the fuel pressurizing chamber 17 via the opening portion between the valve member 21 and the valve seat 23, fuel sucked from the fuel intake passage 51 into the fuel pressurizing chamber 17, and fuel exhausted to the outside of the pump 1 via the fuel delivery passage 32. In other words, fuel passing through the annular fuel chamber 25 is all of fuel supplied to the pump 1. The large amount of fuel (the all fuel supplied to the pump 1) is supplied to the fuel intake passage 51 after contacting the electromagnetic valve 20. Therefore, the solenoid 423 is cooled by such fuel, and accordingly, operational failure of the electromagnetic valve 20 accompanied by temperature rise can be prevented.

(Seventh Embodiment)

Figure 14:
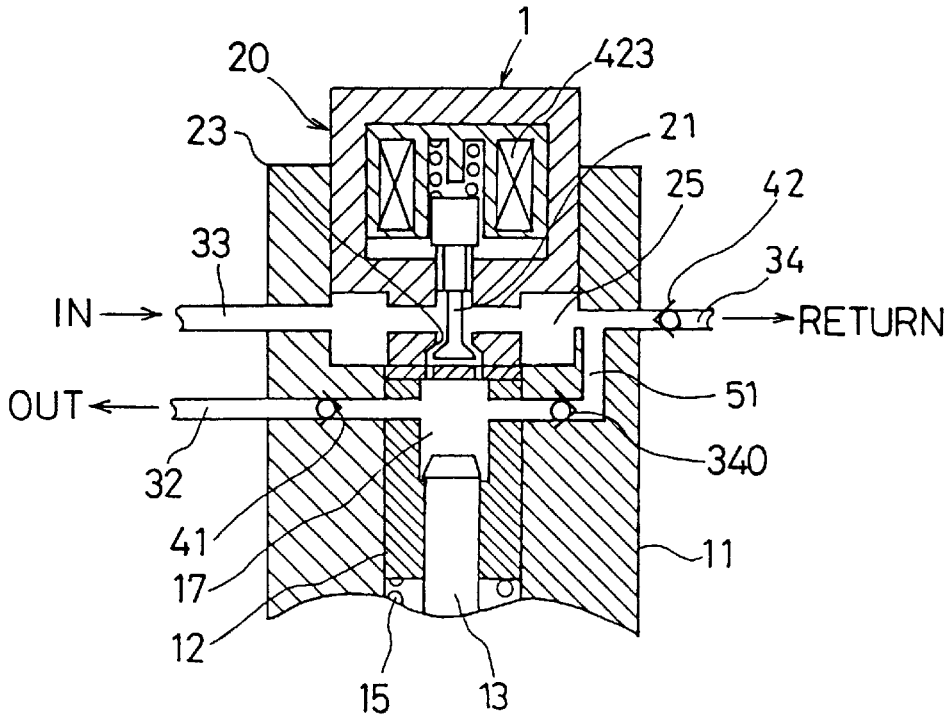
FIG. 14 is a part of a longitudinal sectional view of a high pressure fuel pump according to a seventh embodiment of the present invention.
Figure 15:
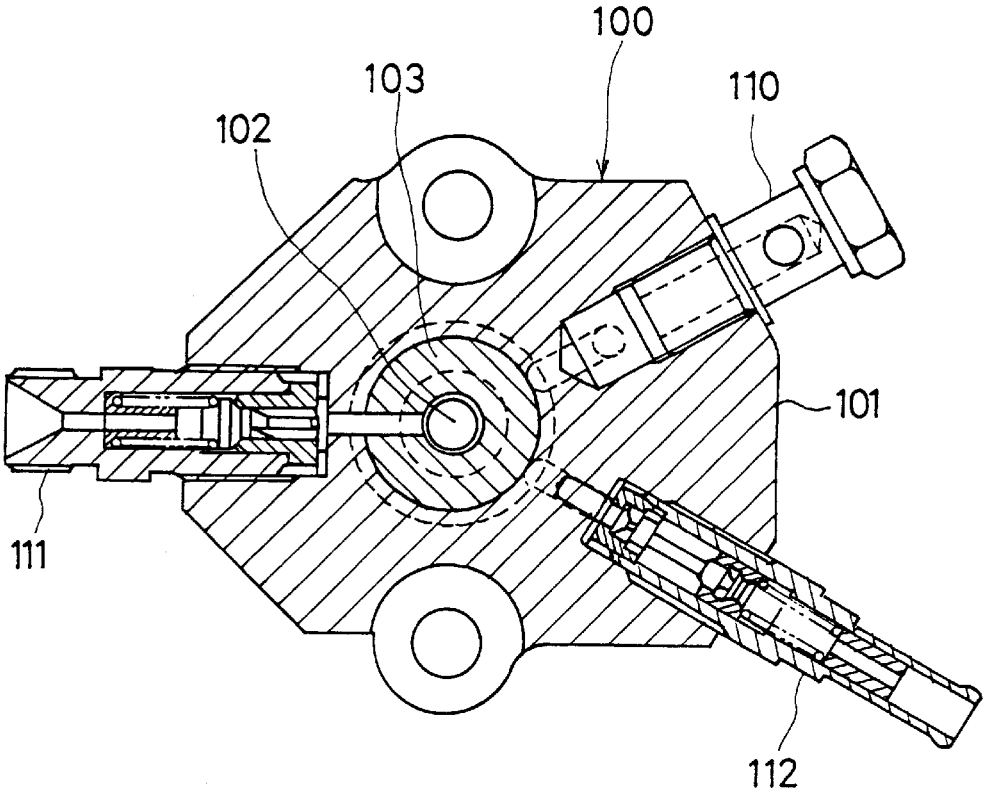
FIG. 15 PRIOR ART
FIG. 15 is a partial transverse sectional view of a conventional high pressure fuel pump.
Figure 16:
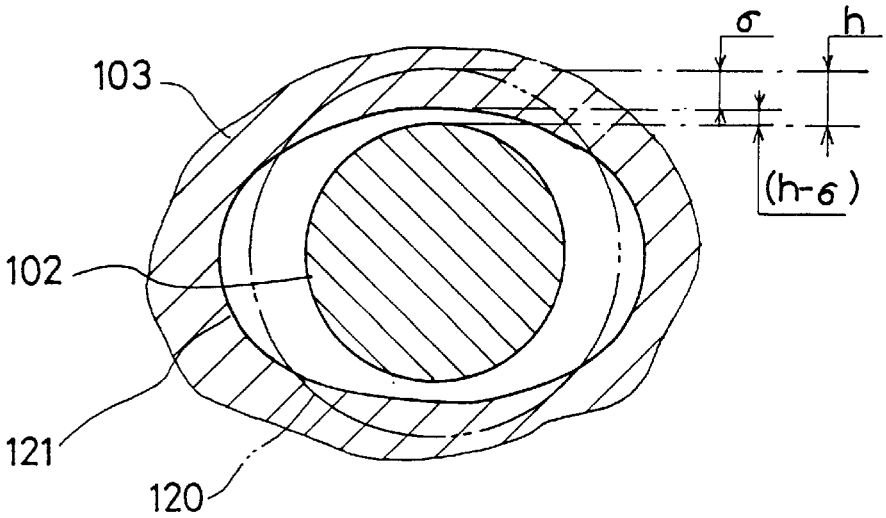
FIG. 16 PRIOR ART
FIG. 16 is a schematic illustration to show a deformation of a cylinder when attachment parts are threadably attached to a housing of the conventional high pressure fuel pump.
Figure 17:
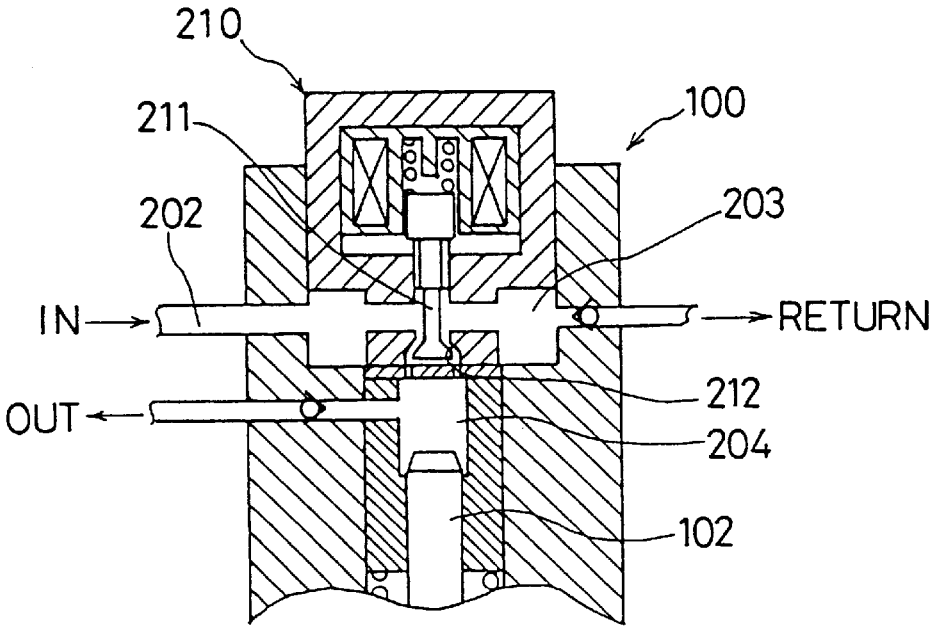
FIG. 17 PRIOR ART
FIG. 17 is a part of a longitudinal sectional view of a conventional high pressure fuel pump.
Figure 18:
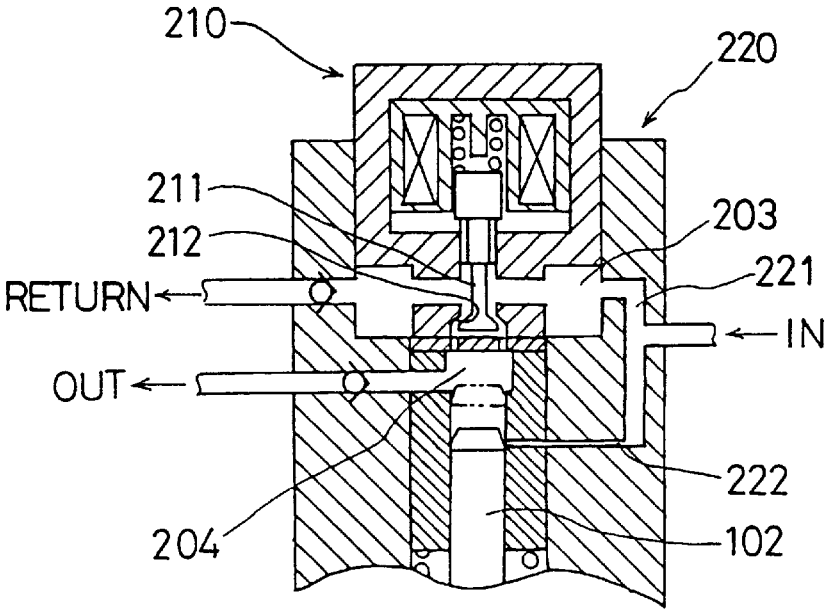
FIG. 18 PRIOR ART
FIG. 18 is a part of a longitudinal sectional view of a conventional high pressure fuel pump.

A seventh embodiment of the present invention is shown in FIG. 14.

Although the pressure regulator 42 is directly installed in the housing 11 of the high pressure fuel pump 1 in the sixth embodiment, the pressure regulator 42 is installed in a fuel pipe connected to the high pressure fuel pump 1. Therefore, a mounting space for the high pressure fuel pump 1 can be reduced.

According to the above-described third, fifth, sixth and seventh embodiments of the present invention, since there are two paths for sucking fuel into the fuel pressurizing chamber 17, a necessary fuel amount per intake stroke can be sucked even when the reciprocating speed of the plunger 13 is increased to increase the fuel delivery amount per predetermined time period. Furthermore, by installing the check valve 340 in the fuel intake passage directly communicating with the fuel pressurizing chamber 17, the fuel pressurizing chamber 17 is hermetically sealed when the electromagnetic valve 20 is closed in elevating the plunger 13 toward the top dead center, because the check valve 340 is closed by fuel pressure of the fuel pressurizing chamber 17. Accordingly, the pressurized transferring stroke is started immediately after closing the electromagnetic valve 20. Therefore, a large amount of fuel per predetermined time period can be delivered without lowering the fuel delivery efficiency.

Although the present invention has been described in connection with the preferred embodiments thereof with reference to the accompanying drawings, it is to be noted that various changes and modifications will be apparent to those skilled in the art. Such changes and modifications are to be understood as being included within the scope of the present invention as defined in the appended claims.

What is claimed is:

1. A fuel supply apparatus for supplying high pressure fuel to a fuel injection device of an internal combustion engine, comprising:

a housing defining a cylinder, a fuel pressurizing chamber and a seat surface;

a plunger reciprocatably housed within said cylinder for pressurizing fuel input into said pressurizing chamber;

an attachment member secured into said seat surface of said housing;

the housing including a first fuel passage radially formed in a plane substantially normal to an axis of said cylinder so as to extend radially from the cylinder and communicated with the attachment member; and said seat surface being oriented relative to said cylinder such that a hypothetical axially-extended seat surface does not intersect said cylinder, wherein said housing and said cylinder are separate members, and said hypothetical extended seat surface is located outside an outer peripheral surface of said cylinder, wherein the attachment member is received in a threaded hole formed in said housing, and said seat surface is a bottom portion of said threaded hole, and wherein:

said housing has a second fuel passage having a uniform fuel pressure; and there are a plurality of attachment members, each being oriented relative to said cylinder such that a hypothetical axially-extended seat surface thereof does not intersect said cylinder, and wherein at least two of said attachment members oppose each other and are both attached to one of said first and second fuel passages.

2. A fuel supply apparatus according to claim 1, wherein said attachment member is threadably attached to said housing so as to be embedded in the housing.

3. A fuel supply apparatus for supplying high pressure fuel to a fuel injection device of an internal combustion engine, comprising:

a housing defining a cylinder, a fuel pressurizing chamber and a seat surface;

a plunger reciprocatably housed within said cylinder for pressurizing fuel input into said pressurizing chamber;

an attachment member secured into said seat surface of said housing;

the housing including a first fuel passage radially formed in a plane substantially normal to an axis of said cylinder so as to extend radially from the cylinder and communicated with the attachment member; and said seat surface being oriented relative to said cylinder such that a hypothetical axially-extended seat surface does not intersect said cylinder, wherein said housing and said cylinder are separate members, and said hypothetical extended seat surface is located outside an outer peripheral surface of said cylinder, wherein the attachment member is received in a threaded hole formed in said housing, and said seat surface is a bottom portion of said threaded hole, and wherein:

said housing further defines a constraint portion for receiving a retainer to affix said fuel supply apparatus to the engine; and a securing direction of said attachment member is parallel with a line extending between axial centerlines of said cylinder and said constraint portion.

4. A fuel supply apparatus for supplying high pressure fuel to a fuel injection device, comprising:

a housing having a cylinder, a fuel pressurizing chamber and a seat surface;

a plunger reciprocatably housed within said cylinder for pressurizing fuel input into said pressurizing chamber;

an attachment member attached to said seat surface such that a hypothetical axially-extended seat surface is skewed relative to said cylinder; and the housing including a fuel passage radially formed in a plane substantially normal to an axis of said cylinder so as to extend radially from the cylinder and communicated with the attachment member, wherein:

said housing has a second fuel passage having a uniform fuel pressure; and there are a plurality of attachment members, each being oriented relative to said cylinder such that a hypothetical axially-extended seat surface thereof does not intersect said cylinder, and wherein at least two of said attachment members oppose each other and are both attached to one of said first and second fuel passages.

5. A fuel supply apparatus according to claim 4, wherein the attachment member is embedded in the housing.

6. A fuel supply apparatus according to claim 5, wherein the attachment member is received in a threaded hole formed in said housing.

7. A fuel supply apparatus according to claim 6, wherein said seat surface is a bottom portion of said threaded hole.

8. A fuel supply apparatus according to claim 3, wherein said attachment member is threadably attached to said housing so as to be embedded in the housing.

* * * * *

UNITED STATES PATENT AND TRADEMARK OFFICE

CERTIFICATE OF CORRECTION

PATENT NO. : 6,123,059
DATED : September 26, 2000
INVENTOR(S) : INAGUMA et al

It is certified that error appears in the above-identified patent and that said Letters Patent is hereby corrected as shown below:

On the Title Page, Item

"[75] Inventors: Yoshitsugu Inaguma, Chita-gun;

Nobuo Oota, Takahama-city, both of Japan."

should be

--[75] Inventors: Yoshitsugu Inaguma, Chita-gun;

Nobuo Oota, Takahama-city;

Hiroshi Inoue, Chiryu-city, all of Japan--

Signed and Sealed this

Fifteenth Day of May, 2001

*Attest:*

Nicholas P. Godici

NICHOLAS P. GODICI

*Attesting Officer*

*Acting Director of the United States Patent and Trademark Office*